US006575268B2

(12) United States Patent
Carder et al.

(10) Patent No.: US 6,575,268 B2
(45) Date of Patent: Jun. 10, 2003

(54) LADDER SCAFFOLDING SUPPORT APPARATUS AND SCAFFOLDING SYSTEM

(76) Inventors: Wilburn Jerry Carder, 3941 Price Rd., Gainesville, GA (US) 30506; Charles Wesley Clark, 4955 Lee Rd., Gainesville, GA (US) 30506

( * ) Notice: Subject to any disclaimer, the term of this patent is extended or adjusted under 35 U.S.C. 154(b) by 0 days.

(21) Appl. No.: 09/957,766

(22) Filed: Sep. 21, 2001

(65) Prior Publication Data

US 2003/0057020 A1 Mar. 27, 2003

(51) Int. Cl.[7] ..... E06C 7/16; E04G 1/00
(52) U.S. Cl. ..... 182/118; 182/229
(58) Field of Search ..... 182/117, 118, 182/107, 214, 229

(56) References Cited

U.S. PATENT DOCUMENTS 3,792,750 A * 2/1974 Madison ..... 182/106
5,165,501 A * 11/1992 Donahey ..... 182/107
5,638,914 A * 6/1997 Kizzia ..... 182/117
5,862,881 A * 1/1999 O'Brien ..... 182/117

* cited by examiner

*Primary Examiner*—Alvin Chin-Shue
(74) *Attorney, Agent, or Firm*—Hinkle & O'Bradovich, LLC

(57) ABSTRACT

A ladder scaffold support apparatus, ladder stabilizer and ladder scaffolding system is disclosed. The support apparatus generally includes a first bar connected to a second bar at an angle. The bars include planar pads adapted to be affixed to a wall. The apparatus further includes a third bar that is in telescopic arrangement with the first bar. The third bar is adapted to fit through the rung of a ladder. Several brackets can be used to stabilize a ladder against a surface, typically a wall. When one or more ladders are used in conjunction with a platform, the brackets can be used to affix the ladders to a wall. The platform is laid on the rungs of the ladders thereby creating a scaffolding system.

8 Claims, 3 Drawing Sheets

205
230
200
215
235
220
225
230
210
216
225
220

401
402
416
402
445
405
420
415
480
490
480
410
400
480
402
480
420

LADDER SCAFFOLDING SUPPORT APPARATUS AND SCAFFOLDING SYSTEM

BACKGROUND OF THE INVENTION

I. Field of the Invention

The present invention relates generally to the field of scaffolds for construction, painting and the like, and more particularly, to a ladder scaffold support apparatus, ladder stabilizer, and scaffolding system.

II. Description of the Related Art

FIG. 1 illustrates a prior art ladder scaffolding system 100. This system 100 typically includes two ladders 105, which can be extension ladders, laid against a wall 110. The system 100 also includes brackets 115 that can be mounted on the wall 110 and laid on the rungs 120 of the ladders 105. The system typically further includes a walking platform 125 that is laid on the brackets 115. The walking platform 125 is used by a user of the system 100 to work (e.g., paint, put up siding etc.) on the wall 110. Additional support lines 130 can be connected to the platform 125 and the rungs 120 to provide additional support.

The system 100 has several disadvantages. The ladders 105 are typically supported only by frictional forces of the ground 135 and the wall 110. In addition the ladders 105 typically cannot be used to climb on for additional access to the wall 110. Furthermore, the platform 125 only gives access to one level of the wall. Therefore, when a higher or different part of the wall 110 is desired, the system 100 has to be taken down and set up again, placing the platform at the desired level. This taking down and setting up typically takes time and labor away from the project.

SUMMARY OF THE INVENTION

In accordance with the present invention and the contemplated problems which have and continue to exist in this field, the invention features a is ladder scaffold support apparatus, ladder stabilizer and ladder scaffolding system.

In general, in one aspect, the invention features a ladder scaffold support bracket, including a first bar having a first end and second end, and a hollow interior a second bar having a first end and a second end, connected to the first bar at an angle and a third bar supported within the hollow interior of the first bar, and protruding out of the hollow interior.

In one implementation, the first bar and second bar further include substantially planar pads connected perpendicularly to the second ends of the bars, and the pads further comprise a plurality of holes.

In another implementation, the first bar further comprises a pair of aligned locking pin holes and the third bar further includes a plurality of aligned locking pin hole pairs and an end piece.

In another implementation, the bracket includes a locking pin adapted to connect through the pair of aligned locking pins of the first bar and through one of the plurality of aligned locking pin hole pairs of the third bar, thereby holding the third bar within a portion of the hollow interior of the first bar.

In still another implementation, the third bar further includes an end piece connected to the end of the third bar that protrudes from the first bar, the end piece having a diameter larger than the diameter of the third bar.

In another aspect, the invention features a ladder stabilizer, including a first tubular body and second tubular body arranged along a common longitudinal axis so that the second tubular body can telescope in and out of the first tubular body, a locking pin adapted to fit through the first and second tubular bodies at a direction perpendicular to the longitudinal axis, thereby fixing the first and second tubular bodies at a fixed length and a third tubular body connected to the first tubular body at an angle.

In one implementation, the stabilizer includes planar support pads aligned in a common plane, one pad being connected to the first tubular body and the other pad being connected to the third tubular body.

In another implementation, the longitudinal axis is substantially perpendicular to the common plane and the third tubular body is at an angle to the common plane.

In another implementation, the second tubular body is adapted to fit through a rung of an extension ladder, the rung having a diameter.

In still another implementation, the second tubular body includes an end piece having a diameter larger than the diameter of the second tubular body and the diameter of the rung.

In yet another implementation, the pads are adapted to be affixed to a wall and share a common plane.

In another aspect, the invention features a scaffolding system, including a first ladder a second ladder, a plurality of ladder scaffold brackets, each including a first bar having a first end and second end, and a hollow interior, a second bar having a first end and a second end, the first end of the second bar being connected the first bar approximately at the first end at an angle, a third bar supported within the hollow interior of the first bar, and protruding out of the hollow interior, wherein the third bars of the brackets are adapted to fit within rungs of the ladders and a platform adapted to be laid across a rung of the first ladder and a rung of the second ladder.

In one implementation, the system includes a plurality of locking pins adapted to connect and secure into place the first and third bars.

In another implementation, the system further includes a first planar pad connected to the second end of the first bar and a second planar pad connected to the second end of the second bar, the pads being adapted to be affixed to surface with nails.

In another implementation, the system includes a cross bar having a first and second end, the first and second ends having connector to receive a third bar of the brackets, thereby connecting the cross bar to the ladders and a support line connected to the cross bar and adapted to be connected to a user of the system.

One advantage of the invention is that the ladder scaffolding system can be set up once for a project having several levels without having to change the set-up when different levels of the project have to be accessed.

Another advantage is the ladders of the system can be set on unlevel ground while the platform of the system remains level.

Another advantage is that the ladders affixed to a wall are secured to the walls with nails, screws and the like and does not have to rely just on friction.

Other objects, advantages and capabilities of the invention will become apparent from the following description taken in conjunction with the accompanying drawings showing the preferred embodiment of the invention.

DETAILED DESCRIPTION OF THE INVENTION

Figure 2:
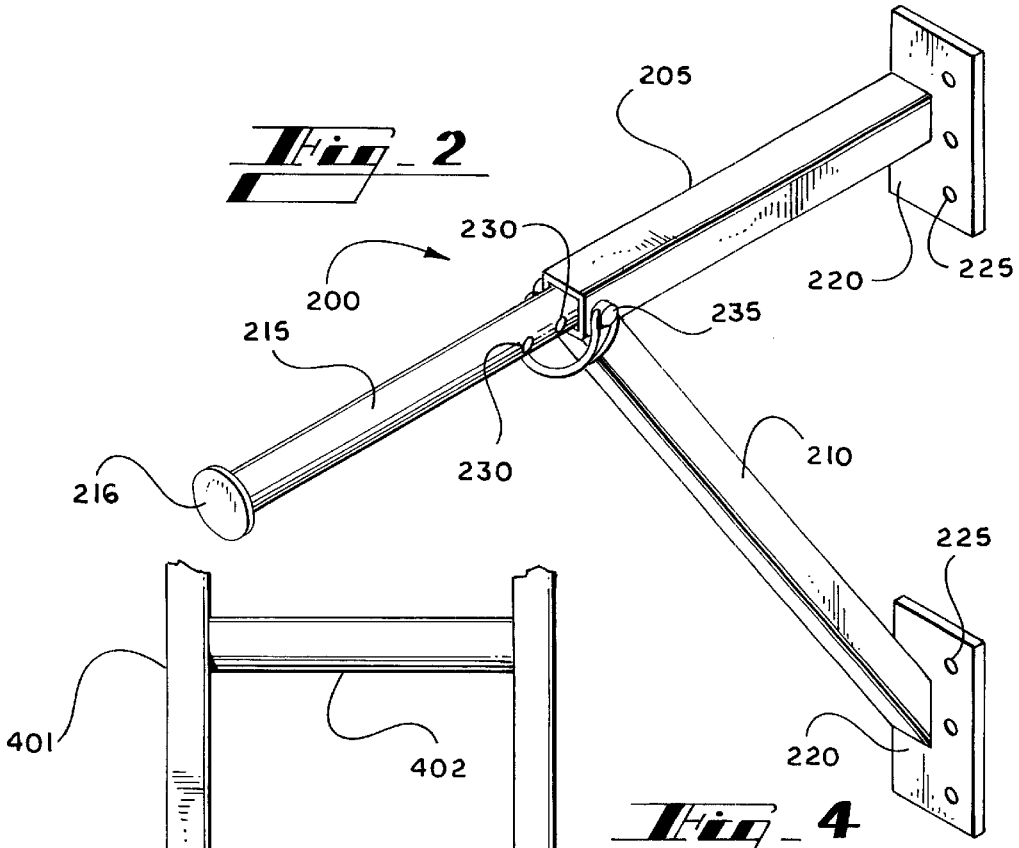
FIG. 2 illustrates an embodiment of a ladder scaffold support apparatus.

Referring to the drawings wherein like reference numerals designate corresponding parts throughout the several figures, reference is made first to FIG. 2 that illustrates an embodiment of a ladder scaffold support apparatus 200. The apparatus 200 typically includes a first bar 205 connected to a second bar 210. The second bar typically connects to one end of the first bar 205 at an angle. Planar pads 220 are connected to each bar 205, 210 at the opposite ends of the bars 205, 210 at which the bars 205, 210 are connected. Each of the pads 220 include a plurality of holes 225 that are typically used to insert nails screws and the like to attach to a surface, typically a wall, as described below with respect to FIG. 4.

The first bar 205 is typically a tubular body having a hollow interior so that a third bar 215 can be inserted within the hollow interior of the bar 205. The first and third bars 205, 215 are in a telescopic arrangement so that the third bar 215 can be inserted in and out of the first bar 205. The second bar can be tubular or solid. The third bar 215 includes a plurality of aligned locking pin hole pairs 230. Each pair 230 is located on opposing sides of the third bar 215 and each pair 230 runs through the bar 215. The third bar 215 also includes an end piece 216 that typically has a wider diameter than the diameter of the third bar 215. The first and second bars 205, 210 are shown having a square cross section, and the third bar 215 and end piece 216 are shown having a circular cross section. It is understood that these components of the system 200 can have other geometric cross sections.

The apparatus 200 further includes a locking pin 235.

Figure 1:
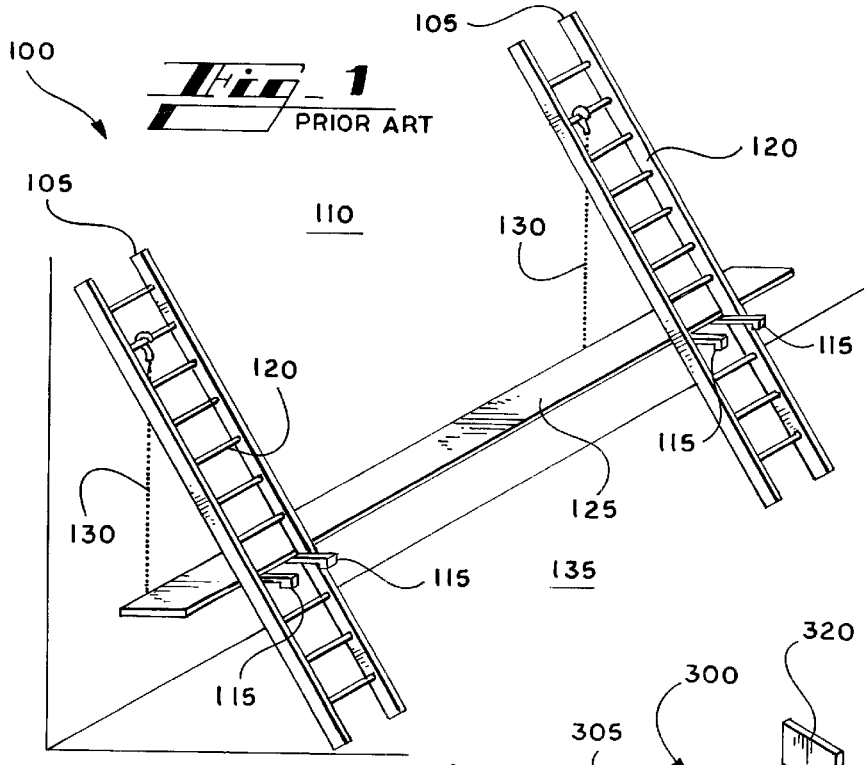
Fig 1 PRIOR ART
FIG. 1 illustrates a prior art scaffolding system.
Figure 3:
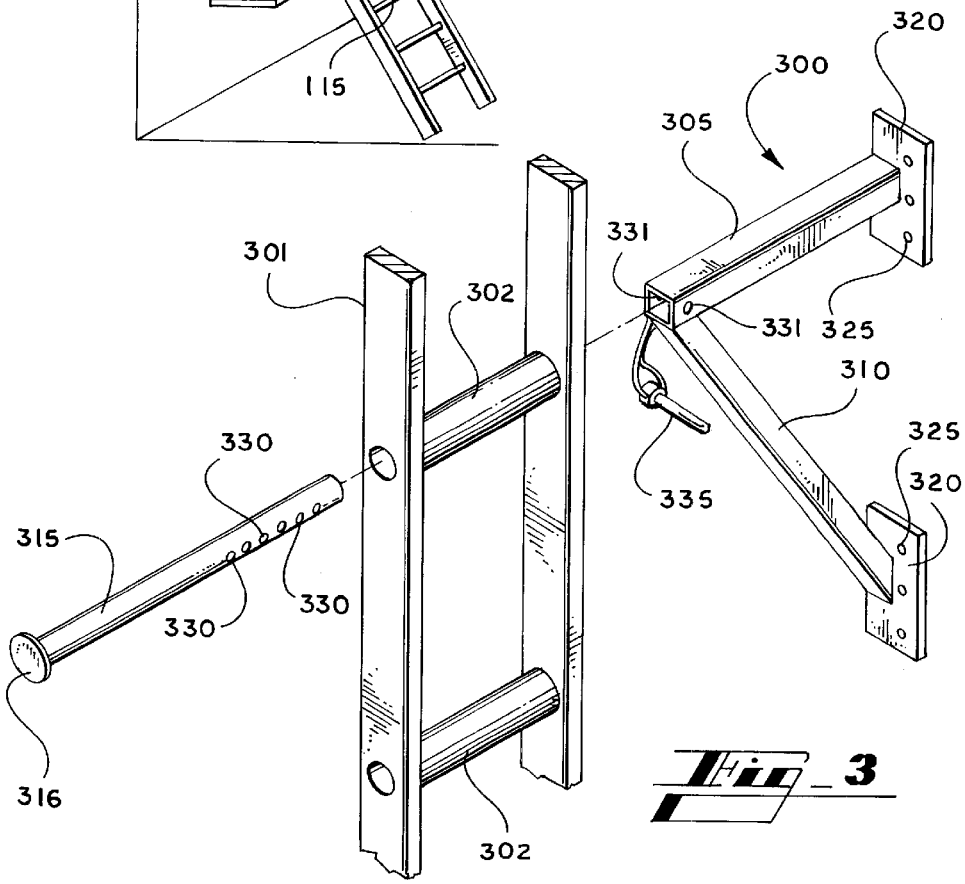
FIG. 3 illustrates a perspective view of a portion of an extension ladder and an embodiment of a ladder scaffold support apparatus.

The aligned locking pin hole pairs 230, the locking pin 235 and an additional pair of holes (not shown) located on the first bar are now described in further detail with respect to FIG. 3 that illustrates a perspective view of a portion of an extension ladder 301 and an embodiment of a ladder scaffold support apparatus 300. As described above, the apparatus 300 includes a first bar 305, a second bar 310 and a third bar 315. The first and second bars 305, 310 include planar mounting pads 320. The third bar 315 has been removed from the first bar 305. The third bar 315 includes a plurality of aligned locking pin home pairs 330 through which the locking pin 335 can be placed when the third bar 315 is replaced in telescopic arrangement with the first bar 305. As shown, the first bar has a pair of aligned holes 331 through which the locking pin 335 can be placed. It is now seen that the locking pin 335 when placed through the respective aligned holes 330 and 331, locks the third bar 315 into the first bar 305. The telescopic arrangement of the first and third bars 305, 315 allows the total length of the bars 305, 315 to be varied.

FIG. 3 further illustrates a portion of an extension ladder 301. As known in the art, an extension ladder (a portion 301 of which is shown) has at least two ladder sections that can be extended and retracted to make the ladder 301 longer or shorter. The rungs 302 of extension ladders are typically tubular bodies. FIG. 3 illustrates that the third bar 315 is adapted to fit through the hollow interior of the rung 302 and into the first bar 305. The diameter of the third bar 315 is such that the third bar 315 can fit into the diameter of the rung 302. The end piece 316 has a wider diameter than the rung 302 so that the third bar cannot slide out of the other side of the ladder. The diameter of the end piece is generally larger than the diameters of the third body 315, the first body 305 and the rungs 302.

Figure 4:
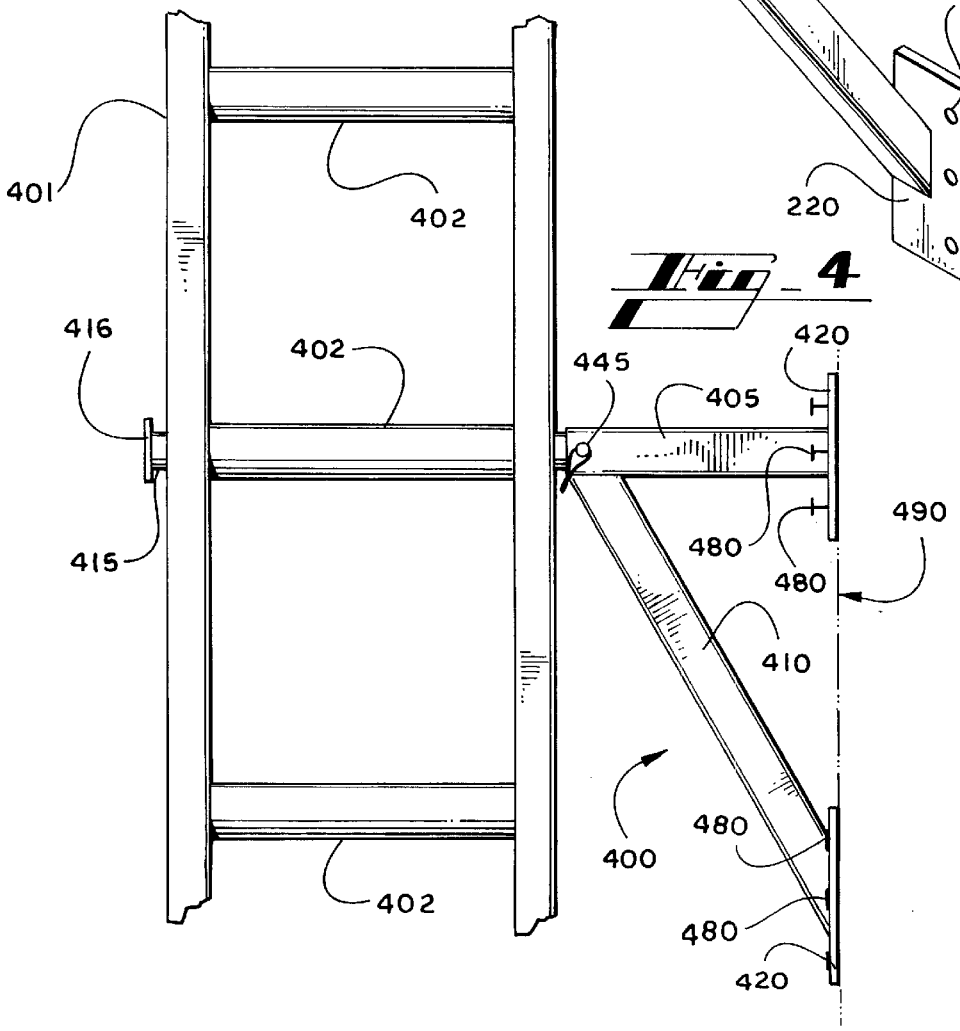
FIG. 4 illustrates a view of a portion of an extension ladder and an embodiment of a ladder scaffold support apparatus.

FIG. 4 illustrates a view of a portion of an extension ladder 401 and an embodiment of a ladder scaffold support apparatus 400. FIG. 4 shows that the apparatus 400 has been nailed to a wall 490. Nails 480 have been placed though the holes (not shown) on the pads 420 to secure the apparatus 400 to the wall 490. It is understood that other devices such as screws can be used to affix the pads 420 to the wall 490. It is also seen that the pads 420 share a common plane, here represented by the wall 490. This common planar arrangement helps to ensure that the apparatus 400 has a flush fit with the wall 490. The first bar 405 is substantially perpendicular with the wall 490 and the second bar 410 is angled with respect to both the first bar 405 (as described above) and the wall 490. The third bar 415 has been inserted through a rung 402 of the ladder 401 and into the first bar 405, and secured by the locking pin 445. When more of the apparatuses 400 are added in other rungs 402, the ladder 401 becomes stabilized in a straight up and down orientation against the wall 490. In this way the apparatus 400 acts as a ladder 401 stabilizer.

Typically, a user can set up the apparatus 400 and the ladder 401 by first removing the third bar 415 from the first bar 405, then nailing the pads 420 to the wall 490. The ladder 401, first bar 405 and third bar 415 can be aligned and connected and locked with the locking pin 435. Further apparatuses 400 can then be added to the ladder 401 and secured to the wall 490. The user can then start climbing the ladder 401 to add additional apparatuses 400 at higher levels on the wall 490.

Figure 5:
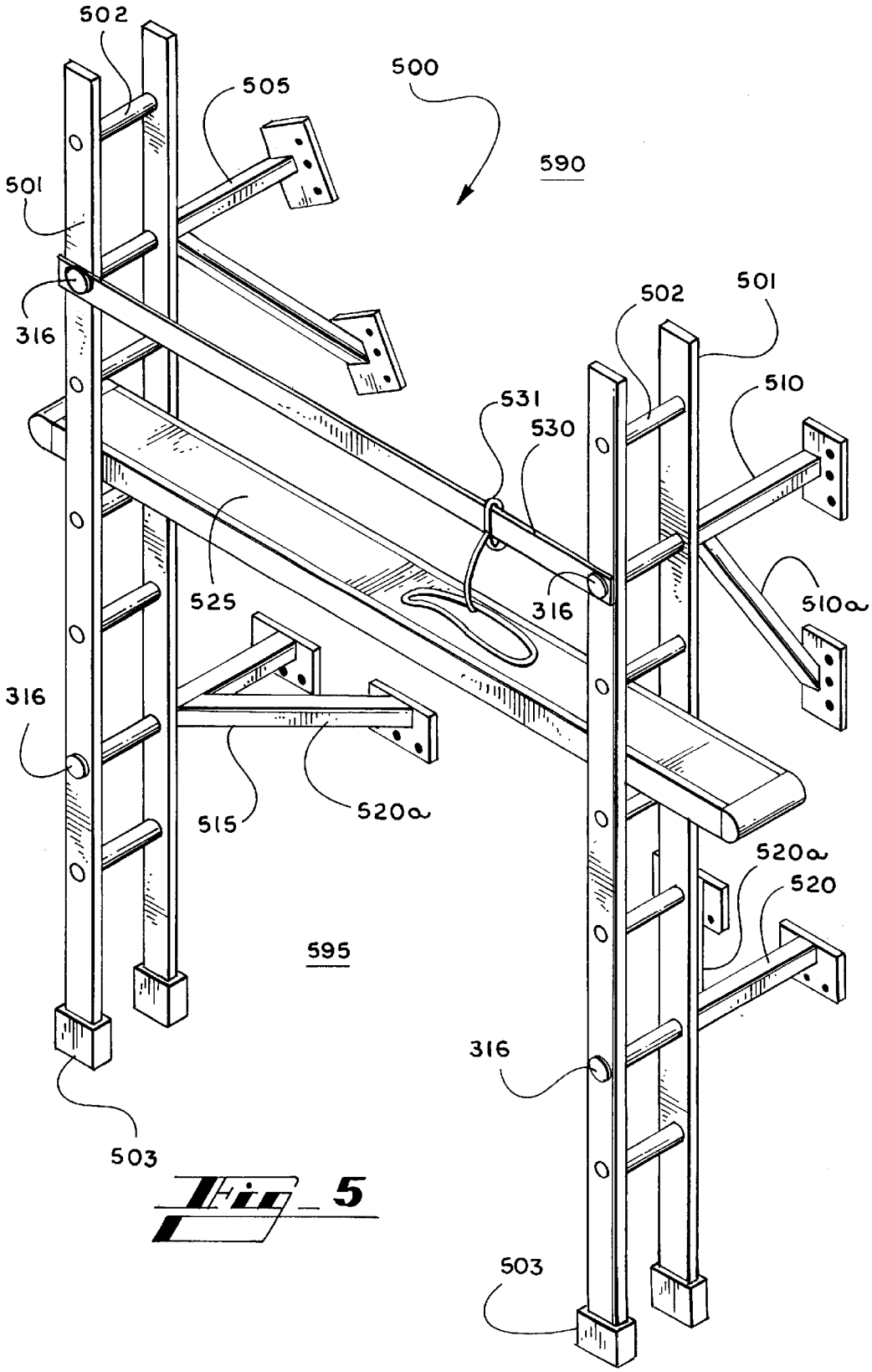
FIG. 5 illustrates an embodiment of a scaffolding system.

FIG. 5 illustrates an embodiment of a scaffolding system 500. The system 500 typically includes a plurality of ladder scaffold support apparatuses 505, 510, 515, 520, two extension ladders 501 and a walking platform 525. The walking platform is rested on the rungs 502 of each ladder 501. The rungs 502 to lay the platform 525 are chosen that makes the platform 525 most level and suitable for walking and working.

Typically, the system 500 is set up first by affixing the apparatuses 505, 510, 515, 520 on the wall 590, and the ladders on the apparatuses 505, 510, 515, 520 as described above. The user(s) of the system 500 can then climb the ladders 501 with the platform 525 and place it on the most suitable rungs 502.

Often times, the ground 595 next to the wall 590 is not level. In such a case, the ladders can be set so that the bottoms 503 of the ladders 501 rest on the ground. The apparatuses 505, 510, 515, 520 are added and the ladders 501 are affixed. Even though the ladders are not on the same level on the ground, the platform 525 can still be arranged on suitable rungs 502 so that the platform is mostly level.

The apparatuses 505, 510, 515, 520 are shown in different orientations. These different orientations allow for flexibility of placement of the apparatuses 505, 510, 515, 520 because often times there may not be a place to nail the apparatuses

505, 510, 515, 520 onto the wall, due to apertures such as windows. Therefore, the pads of the apparatuses 505, 510, 515, 520 have to be nailed wherever a suitable surface on the wall 590 can be found. The apparatus 505 is shown nailed into the wall 590 at an angle with respect to the ladders 501. The apparatus 510 is shown with the second bar 510*a* facing down and substantially aligned with the ladder 501 in a similar plane of alignment. The apparatuses 515, 520 are shown with their second bars, 515*a*, 520*a*, respectively, aligned substantially perpendicular with planes defined by the ladders. The perpendicular alignment of apparatuses 515, 520 is a desired alignment because it provides the most stable support, preventing a hinging effect of the ladders 501 with respect to the wall. Hinging can be minimized by the perpendicular arrangement because it provides the widest base with respect to the wall and ladders 501. Although the parallel arrangement of the apparatus 505 works sufficiently, it still allows the possibility of a hinging effect of the ladders 501. The angled orientation of apparatus 505 allows for less likelihood of hinging. The angled orientation is also desirable because it prevents the apparatuses 505, 510, 515, 520 from being pulled from the wall due to downward forces on the system 500. The angled orientation is, therefore, useful in distributing downward forces.

In another embodiment, the system 500 can be equipped with a cross bar 530. In one implementation, the cross bar 530 can be a fixed length that can be determined by the length of the platform 525. In another implementation, the cross bar 530 can be adjustable so that the length can be adjusted as needed. The cross bar 530 can be added to one or more of the apparatuses such as apparatuses 505, 510, when the system is set up. The users of the system 500 can hold onto the cross bar 530 while working. A support line 531 can further be added to the cross bar 530. The support line 531 can be connected to the user while the user is walking on the platform 525. The support line 531 can be adapted to run along the cross bar 530 so that the user is not interrupted by the line 531 pulling taut while the user is moving about the platform 525.

If the system is set up in such a way that the cross bar 530 cannot be set at a level suitable for the workers, third bars (see FIGS. 2–4) can be taken from a ladder scaffold support apparatuses not in use and placed through rungs 502 of the ladders 501 that are at a correct level. The locking pins (see FIGS. 2–4) from apparatuses not in use can be placed in the aligned locking hole pairs of the third bars so that the third bars are locked into place in the suitable rungs 502, thereby securing the cross bar 530 at the suitable level.

Other systems similar to system 500 can be added to the system 500. For example, if the system 500 is set up on the ground, and the platform 525 reaches a desired level, but not a level, such as a gable, because it angles to a level narrower than the platform, additional ladders can be added from the platform 525 with additional support apparatuses and a shorter platform. Several additional systems can be added as needed.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A scaffolding system for accessing a surface of a structure, comprising:

a first extension ladder;

a second extension ladder;

a plurality of ladder scaffold brackets being adapted to connect to the surface of the structure, each comprising:

a first bar having a first end, and a second end and a hollow interior, the first bar including a planar pad connected to the second end, the planar pad having a plurality of holes and adapted to be connected to a planar surface;

a second bar having a first end and a second end, the first end of the second bar being connected to the first end of the first bar and extending at a fixed angle with respect to the first bar, the second bar including a planar pad having a plurality of holes connected to its second end and adapted to be connected to said planar surface;

a third bar supported within the hollow interior of the first bar in a telescopic arrangement, and protruding out of the hollow interior, wherein the third bars of the brackets fit within selected, and rungs of the ladders and held within the rungs between an end piece connected to the third bar and the first end of the first bar said end piece having a diameter larger than an internal diameter of the rungs; and a platform laid across a rung of the first ladder and a rung of the second ladder, wherein the first and second extension ladders are held in a upright manner substantially parallel to the planar surface.

2. The system as claimed in claim 1, further comprising a plurality of locking pins adapted to connect and secure into place the first and third bars.

3. The bracket as claimed in claim 1, wherein the first and third bars share a common longitudinal axis.

4. The bracket as claimed in claim 1, wherein the first bar further comprises a pair of aligned locking pin holes.

5. The bracket as claimed in claim 4, wherein the third bar further comprises a plurality of aligned locking pin hole pairs.

6. The bracket as claimed in claim 5, further comprising:

a locking pin adapted to connect through the pair of aligned locking pins of the first bar and through one of the plurality of aligned locking pin hole pairs of the third bar, thereby holding the third bar within a portion of the hollow interior of the first bar.

7. The system as claimed in claim 1, further comprising a cross bar having a first and second end, a first and second ends having connector to receive a third bar of the brackets, thereby connecting the cross bar to the ladders.

8. The system as claimed in claim 7, further comprising a support line connected to the cross bar and adapted to be connected to a user of the system.

* * * * *